313-422 SR
6/14/77 XR 4,029,984

United States Patent [19]
Endriz

[11] 4,029,984
[45] June 14, 1977

[54] FLUORESCENT DISCHARGE COLD CATHODE FOR AN IMAGE DISPLAY DEVICE

[75] Inventor: John Guiry Endriz, Plainsboro, N.J.

[73] Assignee: RCA Corporation, New York, N.Y.

[22] Filed: Nov. 28, 1975

[21] Appl. No.: 636,096

[52] U.S. Cl. ..... 313/96; 313/105 R; 313/400; 313/422

[51] Int. Cl.[2] ..... H01J 39/06; H01J 31/48; H01J 43/10

[58] Field of Search ..... 313/95, 96, 399, 400, 313/103 R, 103 CM, 104, 105 R, 105 CM; 250/213 VT; 340/324 M; 315/150

[56] References Cited

UNITED STATES PATENTS

| | | | |
|---|---|---|---|
| 1,724,298 | 8/1929 | Miller | 315/150 |
| 2,316,772 | 4/1943 | Dench | 315/150 X |
| 2,754,428 | 7/1956 | Franks et al. | 315/150 X |
| 3,415,990 | 12/1968 | Watson | 313/103 R X |
| 3,735,184 | 5/1973 | Maeda | 313/105 R |
| 3,784,831 | 1/1974 | Reif | 250/213 VT |
| 3,825,922 | 7/1974 | Ralph | 313/103 R X |
| 3,904,923 | 9/1975 | Schwartz | 313/105 R X |
| 3,939,374 | 2/1976 | Schagen et al. | 313/95 |

*Primary Examiner*—Gerard R. Strecker
*Attorney, Agent, or Firm*—Glenn H. Bruestle; William H. Murray; Carl L. Silverman

[57] ABSTRACT

A cathodoluminescent image display device utilizes a cold cathode as the source of electrons. The cold cathode comprises a photocathode, an electron multiplier and a fluorescent anode. The structure of the cathode is such that a portion of the light given off by the fluorescent anode is free to feedback and impinge upon the photocathode. The cold cathode disclosed herein is thus a closed loop device having a loop gain G. The electron multiplier has a gain $G_m$ such that the loop gain G of the device is maintained at a value greater than or equal to one thus causing a sustained electron discharge.

10 Claims, 8 Drawing Figures

Fig. 4.
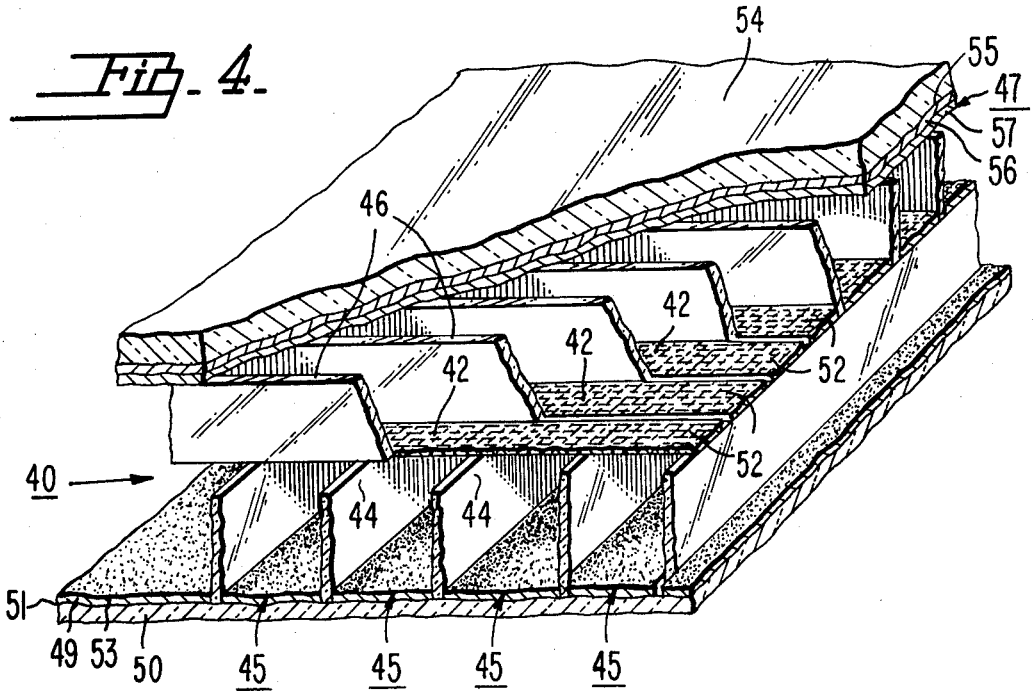
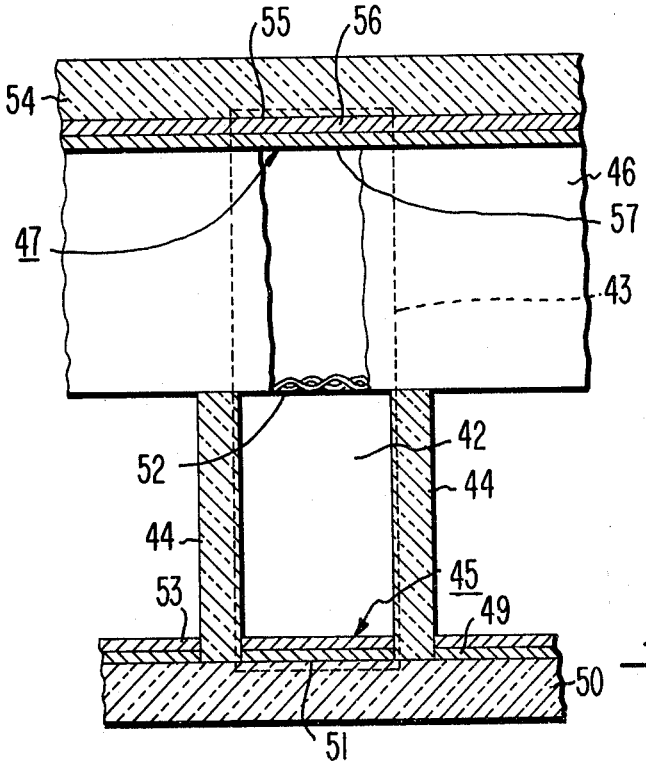
Fig. 5.

FLUORESCENT DISCHARGE COLD CATHODE FOR AN IMAGE DISPLAY DEVICE

BACKGROUND OF THE INVENTION

This invention relates to cold cathode devices and particularly to such a device employing radiation feedback to provide sustained electron generation for use in a cathodoluminescent image display device.

Conventional television picture tubes comprise an elongated glass envelope having a phosphor coated faceplate at one end and an electronic gun at the other end for generating a focused beam of electrons toward the phosphor screen. An elongated structure is required to accommodate the electron gun and deflection system. Consequently, in order to preserve linearity and definition of the display, an increase in the size of the display screen must be accompanied by an increase in the depth of the tube. As a result, a large display screen, for example 75 × 100 cm, would require a beam scanning tube of unmanageable bulk for most practical purposes.

Various solutions to the size-depth-weight problem have been proposed in the form of relatively flat display devices. These proposals have included electroluminescent displays, light valve displays, gas or plasma discharge displays and flat cathodoluminescent displays. Of these various approaches, only the cathodoluminescent display can provide a large, for example 75 × 100 cm, full color image with a sufficient brightness, for example 100 ft-lamberts, while consuming reasonable power, for example less than 1 kilowatt. Presently, all of the other technologies are limited either by power and/or color capabilities.

One principal type of flat, cathodoluminescent display devices that has been proposed comprises a matrix of selectively addressable cathodoluminescent cells employing a multiplicity of straight electron beams. In this type of device, electron sources are provided at each *x-y* location in the array and then the electron flow is controlled in the very short *z* direction perpendicular to the image screen. The major difficulty here is embodied in attempt to provide a large area cathode that would yield adequate emission over an area coextensive with the screen. Thermionic emitters dissipate too much power besides requiring an elaborate technology for effective large area emission. Cold emission devices such as field emitters pose difficult fabrication, structural and materials' problems.

SUMMARY OF THE INVENTION

A cold cathode device comprises an anode electrode and a cathode electrode in a vacuum tight relationship. The anode electrode includes means for producing electromagnetic radiation as a result of bombardment of electrons. The cathode electrode includes means for emitting electrons in response to impinging electromagnetic radiation. An open channel exists between the anode electrode and the cathode electrode whereby a portion of the electromagnetic radiation produced by the anode electrode is clear to feed back to and impinge upon the cathode electrode. Also included are means for accelerating electrons from the cathode electrode to the anode electrode and means for modulating a flow of electrons from the cathode electrode.

BRIEF DESCRIPTION OF THE DRAWINGS

FIG. 4 is a sectioned isometric drawing of an image display device utilizing a matrix of cold cathode devices of type illustrated in FIG. 1.

FIG. 5 is an enlarged sectioned elevational view of a portion of the device illustrated in FIG. 4, depicting one cathodoluminescent cell.

DETAILED DESCRIPTION

Figure 1:
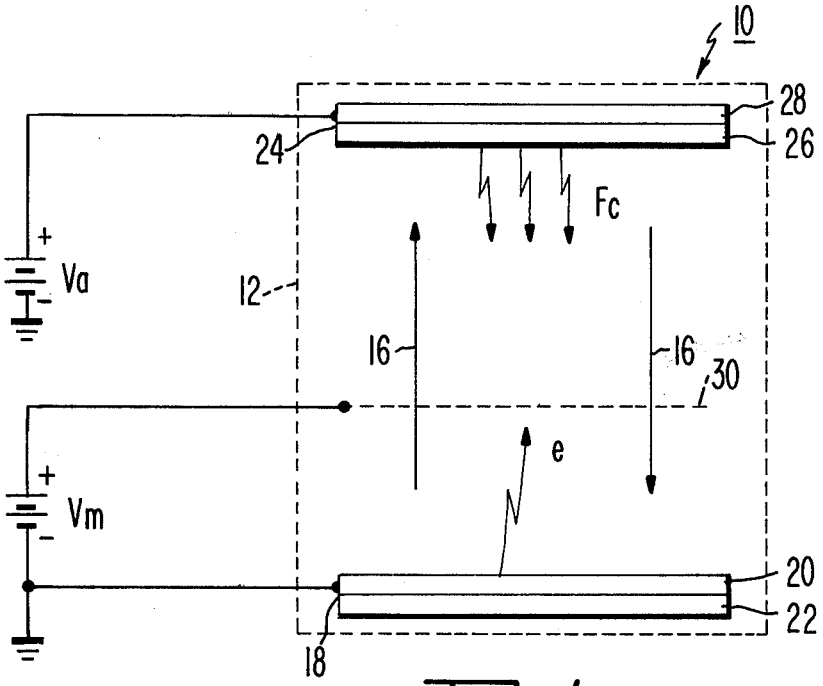
FIG. 1 is a schematic representation of a cold cathode device of the present invention.

A cold cathode device is schematically represented in FIG. 1 and is generally designated as 10 therein. The cold cathode device 10 comprises an evacuated envelope as indicated by the broken line 12. A cathode electrode 18 is disposed within the evacuated envelope 12. The cathode electrode 18 comprises a layer 20 of a photoemissive material, such as cesium antimonide, and a layer 22 of an electrically conductive material, such as copper. It is to be noted that if the photoemissive layer 20 comprises a material which is electrically conductive as well as photoemissive, such as barium, the separate conductive layer 22 would not be required.

An anode electrode 24 is also disposed within the evacuated envelope 12 in opposed spaced relation to the cathode electrode 18. The position of the anode electrode 24 with respect to the cathode electrode 18 is such that an open channel, schematically shown by arrows 16, exists therebetween. In addition, the distance between the anode and cathode electrodes, 24 and 18, must be less than or comparable to either the width or depth of the device envelope 12. The anode electrode 24 comprises a layer 26 of a fluorescent material, such as cerium doped lanthanum phosphate, and a layer 28 of an electrically conductive material, such as aluminum.

A grid electrode 30 is positioned between the anode electrode 24 and the cathode electrode 18. The grid electrode 30 can be at any location between the cathode and anode electrodes, 18 and 24; however, the separation between the grid electrode 30 and the anode electrode 24 must be sufficient to permit the application of a potential difference of several kilovolts. In the preferred embodiment, the grid electrode 30 has a mesh-like or screen structure. However, the grid electrodes may comprise a pair of electrodes in opposed spaced relation or any other type of structure which will permit the establishment of an electric field to control the passage of electrons therethrough without severely obstructing the open channel 16 between the cathode electrode 18 and anode electrode 24.

Referring to FIG. 1, the operation of a cold cathode device of the present invention is as follows. Under the influence of an electrical potential $V_a$ applied between the cathode electrode 18 and the anode electrode 24, a single electron $e^-$ emitted from the photocathode 18 will be accelerated through the grid 30 to the anode 24 with transmission probability A. Consequently, A electrons will then strike the anode 24 at a voltage $V_a$ causing the material in the anode layer 26 to fluoresce. Since the device 10 has a relatively unobstructed open channel 16 between the anode electrode 24 and the photocathode electrode 18, a portion of the fluorescent energy $F_c$ generated in the fluorescent layer 26 will feed back and impinge upon the photocathode 18. If $E_p$ is the anode phosphor fluorescent efficiency and $F_c$ the fraction of fluorescent energy reaching the photocathode, then a photocathode efficiency $E_c$ will result in the emission of $G = F_c \times E_c \times E_p \times A \times V_a$ electrons due to initial emission of a single cathode electron. Clearly, if G is greater than one, the current in the cell will continue to grow until saturation is achieved and sustained electron emission occurs.

Figure 2:
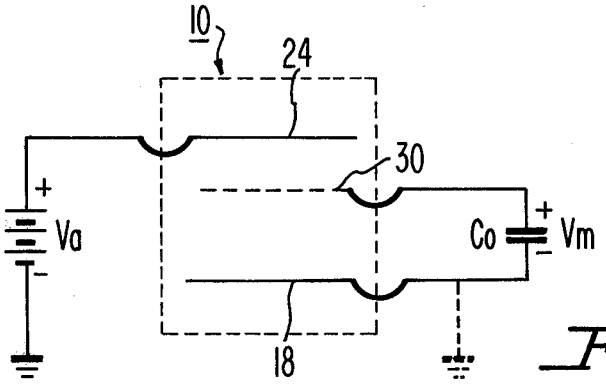
FIG. 2 is a schematic diagram of a form of charge control modulation of the electron flow emitted from the cold cathode device of the present invention.

At least two types of current control and one type of charge control may be used to modulate the flow of electrons emitted from the cold cathode device 10. In the charge control scheme (see FIG. 2), the grid electrode 30 and the cathode electrode 18 are capacitively coupled with the cathode electrode 18 at a more negative potential than the grid electrode. Either the cathode electrode 18 or the grid electrode 30 can be connected to ground in this scheme. Current flow through the grid electrode 30 will discharge the capacitance making the grid electrode 30 sufficiently negative with respect to the cathode electrode 18 to drop the loop gain G below one causing cessation of electron emission. Total charge flow will be comparable to $Q_o = C_o \times V_m$ where $V_m$ is the potential difference between the cathode electrode 18 and the grid electrode 30, and $C_o$ is the capacitance between the grid electrode 30 and the cathode electrode 18. $V_m$ can be relatively small, that is less than 10 volts if desired. Note that the function of the grid electrode 30 is to screen out the high anode field thereby allowing low voltage charge modulation.

Figure 3:
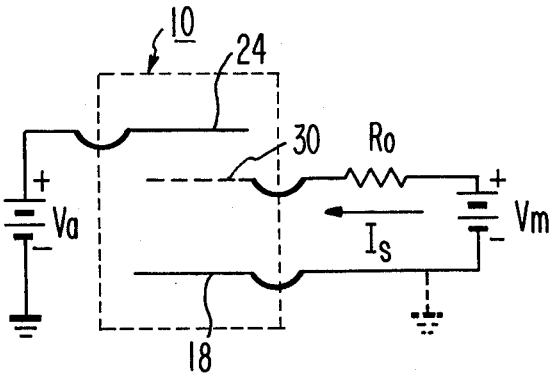
FIG. 3 is a schematic diagram of one form of current control modulation of the electron flow emitted from the cold cathode device of the present invention.

If the discharge is limited through current control, then modulation can be achieved by modulating the "on" time of the uniformly limited current output. One type of current control is resistive loading. As shown in FIG. 3, the grid 30 is biased at a positive voltage $V_m$ relative to the cathode 18. A resistor, having resistance $R_o$, is connected between the grid 30 and the bias voltage source $V_m$. As discharge reaches a certain level, electrons intercepted by the grid 30 (if the cathode 18 is connected to ground) or escaping the cathode 18 (if the grid 30 is connected to ground) will create a current $I_s$ which is approximately equal to $V_m \div R_o$ which is sufficient to drop the cathode-to-grid voltage to where the loop gain is exactly one. Note that $I_s$ can be controlled by varying $V_m$ or $R_o$. Note also that, as in the case of charge control, the purpose of the grid in current control is simply to lower the voltage $V_m$ at which the discharge can be switched. In principle, the grid 30 is superfluous to the operation of the device and in practice, it is apparent that if the device is to be operated DC, then resistive loading at the anode 24 could be used as described above without the grid structure. In this case, $I_s$ would be comparable to $V_a \div R_o$.

Another type of current control is space charge loading. Again, this form of saturation will work in principle without a grid, but space charge saturated currents are low only if the anode voltage can be screened from the cathode region. With the grid, the peak space charge saturated current density $j$ that can be extracted from the cathode is a function of the 3/2 power of the grid to cathode voltage $V_m$ divided by the square of the grid to cathode distance S.

The preceding description outlines how a basic fluorescent discharge cell would operate assuming a loop gain greater than one could in fact be obtained. The materials' related question of anode voltages required to achieve a discharge for a given phosphor and photocathode is considered as follows. In the formula for loop gain $G = F_c \times E_c \times E_p \times A \times V_a$ one can make the reasonable assumption of a high transmission grid (for example $A$ being approximately equal to 0.8) and reasonable proximity of cathode to anode (causing, for example $F_c$ to be approximately equal to 0.2). This implies for $G \geq 1$, $E_c \times E_p \times V_a \geq 6$, or $$V_a \geq \frac{6}{(E_c \times E_p)}.$$

Using this criterion, examples of threshold voltages $V_a$ required to achieve sustained discharge are given for cathode/phosphor combinations in the following Table I.

TABLE I

| Cathode/Phosphor | Phosphor Power Efficiency, $E_p$ (ev/ev) | Fluorescence Wavelength λ | Cathode Power Efficiency, $E_c$ (e'/ev) | Required Anode Voltage, $V_a$ |
|---|---|---|---|---|
| CsSB/22-Z-646A | 0.281 | 4600 Å | $3.8 \times 10^{-2}$ | 600 volts |
| CsSB/$LaPO_4$:Ce | 0.024 | 3150 Å | $4.8 \times 10^{-2}$ | 6 k.V. |
| Ba/33-Z-20D | 0.2176 | 4350 Å | $6.3 \times 10^{-5}$ | 435 k.V. |
| Ba/$LaPO_4$:Ce | 0.024 | 3150 Å | $3.2 \times 10^{-4}$ | 780 K.V. |

It is apparent from Table I that photocathode efficiencies dominate the discharge threshold criterion. If the life and materials' problem of cesiated cathodes can be tolerated, a practical discharge device is feasible for anode voltages less than 1 kV. If life problems require the use of more stable photocathodes, then the anode voltage requirement exceeds 100 kV.

An image display device, generally referred to as 40, utilizing a plurality of cold cathode devices of the present invention in a matrix array, is shown in FIG. 4. An evacuated envelope is formed by a substantially planar substrate 50, a substantially planar faceplate panel 54 and peripheral side walls (not shown) which support the substrate 50 and faceplate panel 54 in substantially parallel spaced relation to each other. The substrate 50 comprises a sheet of an electrically insulating material, such as glass, having an interior surface 51. The faceplate panel 54 comprises a sheet of transparent, electrically insulating material, such as glass, having an interior surface 55.

A matrix of cathodoluminescent cells 42 are defined within the evacuated envelope by the orthogonal intersections of a first set of parallel vanes 44 and a second set of parallel vanes 46. Each vane comprises a strip of an electrically insulating material, such as glass. FIG. 5 depicts one cell 42, the boundaries of which are represented by the dotted line 43. Basically, each individual cell 42 comprises a cold cathode device of the present invention, having a photoemissive cathode electrode, generally referred to as 45, a fluorescent anode electrode, generally referred to as 47, and a substantially open channel between the anode electrode 47 and cathode electrode 45, and a grid electrode 52. The cathode electrode 45 comprises a layer 49 of an electrically conductive material, such as aluminum, disposed on the interior surface 51 of the substrate 50 and a layer 53 of a photoemissive material, such as cesium antimonide, disposed on the conductive layer 49. To facilitate addressing of the image display device, the cathode electrode in the embodiment shown in FIG. 4 is segmented into a plurality of individually addressable cathode strips 45 disposed between adjacent vanes of the first set of vanes 44.

As shown in FIG. 5, the anode electrode 47 comprises a layer 56 of a fluorescent material, such as willemite, which emits visible electromagnetic radiation under electron bombardment, disposed on the interior surface 55 of the faceplate panel 54. An electrically conductive layer 57 is disposed on the fluorescent layer 56. The conductive layer 57 comprises a material, such as tin oxide, which is at least partly transparent to the radiation emitted by the fluorescent layer 56.

Although FIG. 5 shows the fluorescent layer 56 disposed between the faceplate panel 54 and the conductive layer 57, it should be noted that an alternate embodiment (not shown) of the anode electrode may be preferable. The alternate embodiment of the anode electrode comprises: a first fluorescent layer disposed on the interior surface of the faceplate panel; an electrically conductive layer disposed on the first fluorescent layer; and a second fluorescent layer disposed on the conductive layer. The first fluorescent layer comprises a material, such as willemite, which emits visible eletromagnetic radiation. The electrically conductive layer of the alternate embodiment need not the transparent of the visible radiation emitted by the first fluorescent layer. On the contrary, it is desirable that the conductive layer be a reflective material, such as aluminum, in order to enhance the brightness of the display. The second fluorescent layer comprises a material, such as cerium doped lanthanum phosphate, which emits electromagnetic radiation. In this alternate embodiment, the electromagnetic radiation emitted by the second fluorescent layer need not be visible so long as it stimulates the photoemissive material of the cathode causing an emission of electrons therefrom.

To facilitate addressing of the image display device, the grid electrode in the embodiment shown in FIG. 4 is also segmented into a plurality of individually addressable grids 52. Each addressable grid 52 comprises a strip of electrically conductive material, such as copper, having a mesh-like structure, each strip being disposed between adjacent vanes of the second set of vanes 46. In the embodiment shown in FIG. 4, each addressable grid 52 corresponds to a horizontal video line and is substantially coextensive with a horizontal video line as displayed on the faceplate panel 54. Consequently, when describing the operation of this display device, each addressable grid 52 will be referred to as a horizontal address grid and each orthogonal cathode strip 45 will be referred to as a vertical cathode strip. It must be remembered, however, that this combination can be reversed resulting in vertical address grids and horizontal cathode strips and this reversal is intended to be within the scope of this disclosure.

To operate the image display device 40, a voltage $V_a$ is applied to the anode electrode 47 and, using charge control means for modulation, each of the vertical cathode strips 45 receives its own signal voltage $V_c$ prior to the time a horizontal line is to be discharged or displayed. These voltages have a stored charge $Q_e$ which is related to the intrinsic capacitance $C_o$ of the vertical cathode strip and the signal voltage $V_e$ applied thereto, the relationship being expressed as $Q_e = C_o \times V_e$. During charging of these capacitors, all horizontal address grids 52 are biased more negative than even the most negative vertical cathode strip signal. This prevents any of the cells 42 from discharging. Discharge can be induced by switching the horizontal address grid 52 of the horizontal line to be displayed sufficiently positive so that even the lowest signal element (i.e., most positive) is capable of firing.

Upon firing, each of the vertical cathode strips 45 charges more and more positively until all of the elemental voltages $V_e$ are approximately equal to the voltage of the "on" horizontal address grid, $V_{gl}$ "on". Consequently, the amount of charge reaching the fluorescent layer 57 of the anode electrode 47 along th displayed horizontal line is substantially proportional to the initial voltages $V_e$ applied to the vertical cathode strips 45. Operation in this mode corresponds to the charge control mode of modulation previously described.

Similar operation could be achieved by again switching grid voltage $V_{gl}$ to $V_{gl}$ "on" to address a specific horizontal line, but with all vertical cathode strips 45 held to a common voltage which results in common space charge saturation currents between cathode and grid. Still another method would be to load the cathodes with equal resistors so that common resistively saturated currents would result. In these latter current control schemes, modulation can be achieved by terminating the saturated cathode currents through pulse length modulation of the cathodes. This is done by switching each cathode strip to a positive "off" voltage at the proper time. It is also possible, in the resistively saturated case, to modulate the voltage $V_e$ applied to the cathode strips 45 to achieve the desired current level.

As stated above, an amount of charge which is proportional to the initial voltage $V_e$ applied to a vertical cathode strip 45, reaches the fluorescent layer 57 of the anode electrode 47 at voltage $V_a$ causing that portion of the layer 57 within an addressed cell to emit light isotropically. Consequently, a portion of the emitted light will be transmitted through the transparent faceplate panel 54 for external viewing. In addition, a portion of the emitted light will travel through the open channel 43 and impinge upon the photoemissive layer 53 of the cathode 45 causing the emission of more electrons which in turn will travel toward the grid electrode 52 until the elemental voltage $V_e$ is substantially equal to the grid address voltage $V_{gl}$ "on".

As stated previously, the photocathode efficiencies dominate the discharge threshold criterion in the cold cathode device of the present invention. As noted, practical anode voltages of less than 1 kilovolt can be obtained by using cesiated photocathodes. However, for applications such as television displays, which require stable photocathodes having a relatively long life, the use of cesiated photocathodes is not preferred. On the other hand, using more stable photocathodes having the required longevity, such as barium, but having lower efficiency, causes the threshold voltage to rise to an impractical level, that is, in excess of 100 kilovolts. This apparent dilemma can be solved by using electron multiplication means between the cathode electrode and the anode electrode.

Figure 6:
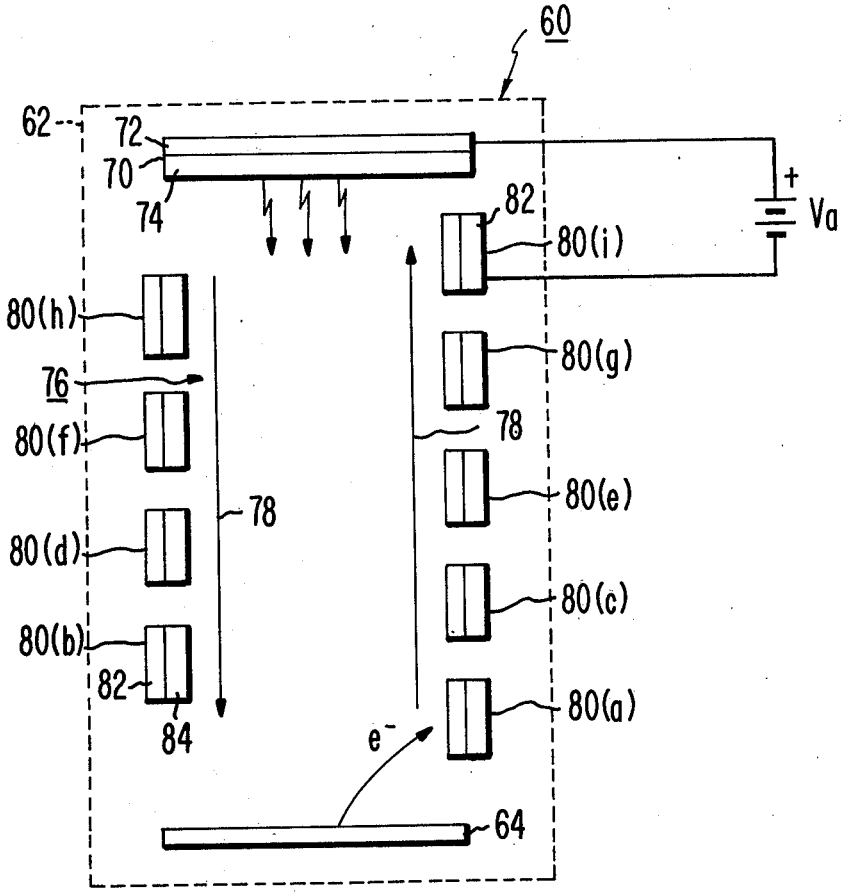
FIG. 6 is a schematic representation of a cold cathode device of the present invention with electron multiplication means.

A cold cathode device utilizing electron multiplication means is schematically represented in FIG. 6 and is generally designated as 60 therein. The cold cathode device 60 comprises an evacuated envelope indicated by the broken line 62. A cathode electrode 64 is disposed within the evacuated envelope 62. The cathode electrode 64 comprises a layer of an electrically conductive, photoemissive material, such as barium. Note that if an electrically insulating photoemissive material, such as cesium antimonide, is used, it must be disposed on a layer of an electrically conductive material as previously described for the cold cathode device 10 in FIG. 1.

An anode electrode 70 is also disposed within the evacuated envelope 62 in opposed spaced relation to the cathode electrode 64. The position of the anode electrode 70 with respect to the cathode electrode 64 is such that an open channel, schematically shown by arrows 78, exists therebetween. The anode electrode 70 comprises a layer 74 of a fluorescent material, such as cerium doped lanthanum phosphate, and a layer 72 of an electrically conductive material, such as aluminum, copper, or tin oxide.

Electron multiplication means in the preferred embodiment comprises an electron multiplier, generally designated as 76 in the schematic representation of FIG. 6. The electron multiplier 76 is positioned within the evacuated envelope 62 between the anode electrode 70 and the cathode electrode 64. The structure of the electron multiplier 76 must be such that it does not substantially obstruct the open channel 78 between the cathode and anode electrodes 64 and 70. The electron multiplier 76 comprises at least one dynode member 80 positioned on the periphery of the open channel 78. Each dynode member 80 comprises a layer 82 of an electrically conductive material, such as aluminum, having a layer 84 of a high secondary emission material, such as magnesium oxide, thereon. In the schematic representation of FIG. 6, nine dynode members 80(*a*) through 80(*i*) are shown. However, the actual number of dynode members 80 required is a function of the desired multiplier gain which will be discussed subsequently.

The operation of the cold cathode device 60 of the present invention utilizing electron multiplication means is as follows. At least one electron $e^-$ will be emitted from the photoemissive layer of the cathode electrode 64 as a result of a spurious event such as stray cosmic radiation, or any source of electromagnetic radition such as an externally applied light source (not shown). Substantially equal voltages are applied between successive dynode members 80. Consequently, the emitted electron $e^-$ strikes secondary-emission layer 84 of the nearest dynode member 80(*a*) thereby producing the emission of more electrons. These electrons strike the next dynode member 80(*b*) and in this manner are multiplied through the electron multiplier 76. If the electron multiplier 76 has a gain $G_m$, each electron $e^-$ emitted from the photoemissive layer will result in $G_m$ electrons at the output of the electron multiplier 76.

An electrical potential $V_a$ is applied between the anode electrode 70 and the final dynode member 80(*i*). The electrical potential $V_a$ is represented by a voltage source in FIG. 6, the positive side being connected to the conductive layer 72 of the anode electrode 70 and the negative side being connected to the conductive layer 82 of the final dynode member 80(*i*). The $G_m$ electrons appearing at the output of the electron multiplier 76 will travel toward the anode electrode 70 under the influence of the electrical potential $V_a$ applied between the anode electrode 70 and the final dynode member 80(*i*), and will strike the fluorescent layer 74 of the anode electrode 70 at voltage $V_a$. The $G_m$ electrons striking the fluoroescent layer 74 will cause the fluorescent material to generate electromagnetic radiation with a fluorescence efficiency $E_p$.

Since the construction of the electron multiplier 76 is such that an open channel 78 is maintained between the fluorescent layer 74 of the anode electrode 70 and the photoemissive layer of the cathode electrode 64, a fraction $F_c$ of the electromagnetic radiation emitted by the fluorescent layer 74 will feed back to and impinge upon the photoemissive layer of the cathode 84 thereby causing additional electrons $e^-$ to be emitted. These emitted electrons will consequently be multiplied through the electron multiplier 76 with a gain $G_m$, subsequently striking the fluorescent layer 74 and producing further electromgnetic radiation. For a single loop, this operation will result in the emission of $G = F_c \times E_c \times E_p \times G_m \times V_a$ electrons due to initial emission of a single electron from a photoemissive layer having a photocathode efficiency $E_c$. Clearly, if G is greater than one, the current in the cell will continue to grow until saturation is achieved and sustained electron emission occurs. The saturation level of electron discharge will be maintained provided the value of G becomes equal to one.

As stated previously, the number of dynode members 80 required is a function of the desired electron multiplier gain $G_m$. In addition, the loop gain G of the device is a function of the electron multiplier gain $G_m$ and must be greater than one for sustained electron discharge to occur. Therefore, for a given optical feedback structure which directly influences the feedback parameter ($F_c$), photocathode efficiency ($E_c$), anode phosphor fluorescence efficiency ($E_p$) and applied voltage ($V_a$) the gain $G_m$ of the electron multiplier 76 must be such that the loop gain G of the device is greater than one. Considering the expression for loop gain G stated above: $G = F_c \times E_c \times E_p \times G_m \times V_a$ it should be noted that the relationship between the gain $G_m$ of the electron multiplier and the applied voltage $V_a$ is such that $V_a$ can be reduced by increasing $G_m$ while maintaining the loop gain G at a value which is greater than or equal to one.

As an illustration of this relationship, consider the following examples. In an embodiment having a photocathode cathode with barium cathode photoemissive layer 64 ($E_c = 3.2 \times 10^{-4} e/eV$ at the emission frequency of lanthanum phosphate); an anode with a cerium doped lanthanum phosphate fluorescent layer 74 ($E_p = 0.024 eV/eV$); a device structure which permits approximately 0.1% of the electromagnetic radiation emitted by the fluorescent layer 74 to feedback and impinge upon the photocathode 64 ($F_c = 10^{-3}$); and a multiplier gain ($G_m$) of $10^4$ the expression for sustained electron emission becomes:

$$1 \leq 10^{-3} \times 3.2 \times 10^{-4} \times 2.4 \times 10^{-2} \times 10^4 \times V_a$$

$$V_a \geq \frac{1}{7.7 \times 10^{-5}}$$

$$V_a \geq 13\text{kV}$$

If the gain of the multiplier $G_m$ is increased from $10^4$ to $10^5$, $V_a$ is reduced to $\geq$ 1.3kV.

It should be noted at this point that the introduction of electron multiplication means in the cold cathode device of the present invention does not change the behavior of the device with respect to the electron flow control mechanisms of charge control or current control. Consequently, the descriptions of charge control and current control relating to a cold cathode device having a grid electrode are equally applicable to a device having electron multiplication means, regardless of whether or not the latter device incorporates a grid electrode as a distinct entity.

Figure 7:
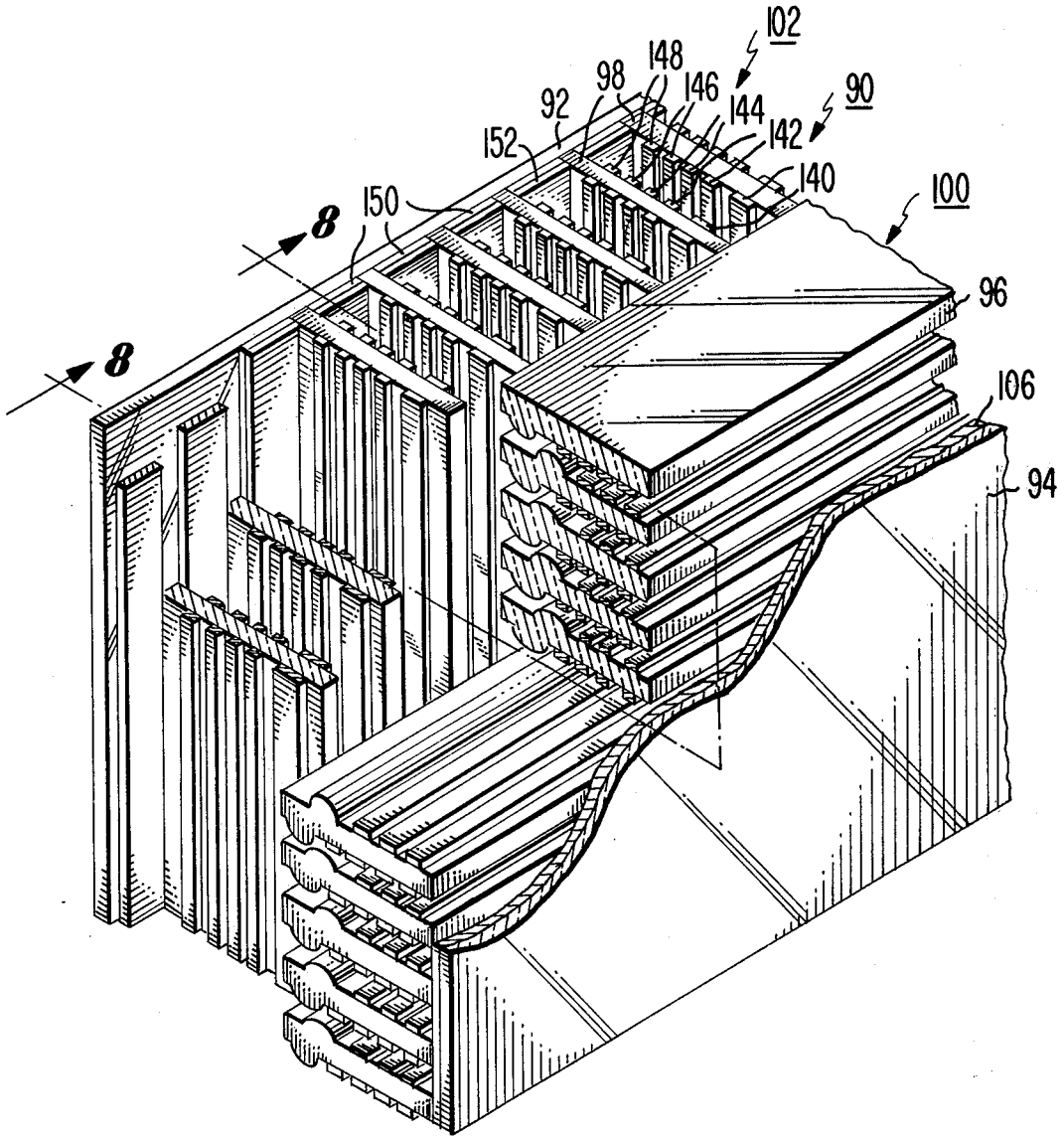
FIG. 7 is a sectioned isometric drawing of an image display device utilizing the cold cathode device of the present invention with electron multiplication means.

The cold cathode device having electron multiplication means described previously is, of course, suitable for any application requiring an efficient cold cathode. However, because of the ability of the device to generate a large quantity of electrons over large areas, this device is particularly useul in cathodoluminescent image displays and particularly those cathodoluminescent displays having a flat profile. FIG. 7 shows one such flat cathodoluminescent image display device, generally designated as 90, utilizing the cold cathode device of the present invention having electron multiplication means. The image display device 90 comprises an evacuated glass envelope having a substantially planar faceplate 92 and a flat back panel 94. The faceplate 92 and back panel 94 are parallel to each other and are sealed together in a vacuum tight relationship by peripheral side walls (not shown).

The present invention may be incorporated into display devices having different internal structures. The particular internal structure selected may be used to support the front and back panels of the device against atmospheric pressure when the device is evacuated. FIG. 7 shows one embodiment of the flat image display device 90 which is capable of such support. Basically, the structure comprises two orthogonal sets of parallel vanes, a horizontal set 96 and a vertical set 98 positioned between the faceplate 92 and the back panel 94. Each vane in the orthogonal sets 96 and 98 comprises strip of an electrically insulating material, such as glass. For descriptive purposes, the flat image display device 90 can be functionally divided into two sections, the cathode section, generally referred to as 100, and the display section, generally referred to as 102. Basically, the cathode section 100 comprises a plurality of cold cathode devices of the present invention, each having a photoemissive cathode, a fluorescent anode, electron multiplication means and an open channel between the anode and cathode.

As shown in FIG. 7, the cathode section 100 includes a substantially planar photocathode 106 which is mounted on and is substantially coextensive with the flat back panel 94. The planar photocathode 106 comprises a layer of an electrically conductive, photoemissive material, such as barium. The set of horizontal parallel vanes 96 are mounted on the planar photocathode 106 in substantially orthogonal spaced relation thereto and in horizontal spaced relation with respect to a viewing area (not shown) on to the faceplate 92. Each vane 96 extends substantially across the entire width of the image display device 90 and has a plurality of striped-shaped electrodes thereon which are substantially coextensive with the length of the vane.

Figure 8:
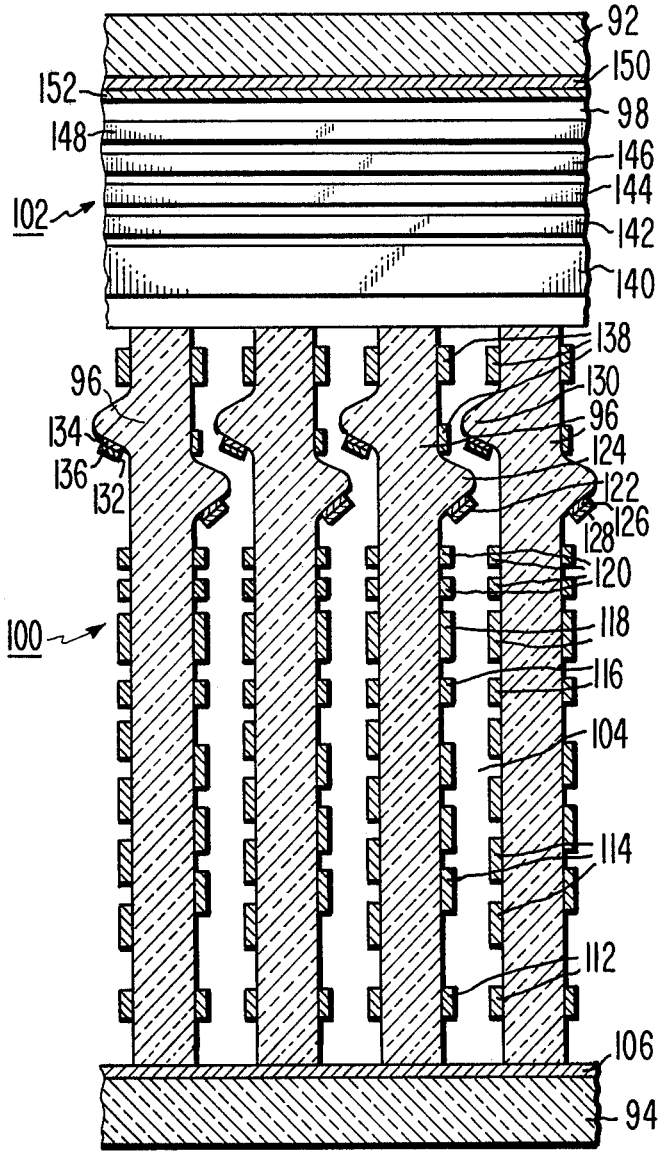
FIG. 8 is a sectional view taken along line 8—8 of FIG. 7.

As shown in FIG. 8, two adjacent parallel vanes 96 form a cold cathode device having an electron multiplier 104 which generates a sheet beam of electrons corresponding to one horizontal dislay line. As shown in FIG. 8, a pair of line address electrodes 112 are located on facing surfaces of adjacent vanes 96 in opposed spaced relationship, adjacent and parallel to the planar cathode 106. Adjacent the line address electrodes, the electron multiplier 104 comprises a plurality of stripe-shaped dynode members 114 in substantially parallel spaced relation to each other and to the line address electrodes 112. A pair of electron extract electrodes 116 are located in opposed spaced relationship adjacent and substantially parallel to the dynode members 114. A pair of drift region electrodes 118 are mounted in opposed spaced relationship adjacent and substantially parallel to the pair of electron extract electrodes 116. A plurality of electron accelerating electrodes 120 are mounted in opposed spaced relationship adjacent in substantially parallel spaced relation to each other and to the pair of drift region electrodes 118.

An anode electrode 122 is disposed on a first ridge 124 of electrically insulating material, on that surface of the ridge which faces toward the planar photocathode 106. The anode electrode 122 comprises a strip 126 of an electrically conductive material, such as aluminum, which is substantially co-extensive with the length of the vane 96. The conductive strip 126 has a layer 128 of a fluorescent material, such as cerium doped lanthanum phosphate, thereon. A second ridge 130 is located on the surface of the adjacent vane 96 facing the first ridge 124. The second ridge 130 is substantially parallel to and adjacent the first ridge 124. A dynode electrode 132 is disposed on a surface of the second ridge 130 which faces toward the photocathode 106. The dynode electrode 132 comprises a strip 134 of an electrically conductive material, such as aluminum, which is substantially co-extensive with the length of the vane 96. The conductive strip 134 has a layer 136 of a high secondary-emission material, such as magnesium oxide, thereon. A plurality of extract electrodes 138 are located in parallel spaced relationship adjacent and substantially parallel to the second ridge 130.

The cathode section 100 of the embodiment disclosed herein generates a plurality of individually addressable electron sheet beams, each electron sheet beam corresponding to a horizontal line in an image display. Each electron sheet beam is generated as follows. Minute quantities of electrons are constantly being emitted from the photoemissive layer of the photocathode 106. However, a negative bias voltage applied to the pair of line address electrodes 112 prevents these electrons from striking the dynode members 114.

When an electron sheet beam is desired at a particular location, the pair of line address electrodes 112 corresponding to that location, will receive a bias voltage which is positive with respect to the voltage applied to the photocathode 106. This positive bias voltage permits electrons from the photoemissive layer of the photocathode 106 to strike the adjacent dynode member 114. These electrons are multiplied through the electron multiplier 104 as previously described. The multiplicity of electrons are than extracted and accelerated toward the anode electrode 122 by the pair of electron extract electrodes 116 and the plurality of electron accelerating electrodes 120 respectively.

A portion of the multiplicity of electrons subsequently strike the fluorescent layer 128 of the anode electrode 122 causing the generation of electromagnetic radiation. In addition, a portion of the multiplicity of electrons will strike the secondary emission layer 136 of the dynode electrode 132 thereby producing the emission of more electrons. These electrons are accelerated toward the display section 102 under the influence of electrical potentials applied to the plurality of extract electrodes 138. A fraction of the electromagnetic radiation generated by those electrons striking the fluorescent layer 128 will feed back and impinge upon the photoemissive layer of the photocathode 106 causing the emission of additional electron electrons.

As stated previously, the gain of the electron multiplier 104 is selected such that the loop gain G of the device is greater than one thereby causing a sustained buildup of an electron flow. As long as the loop gain G of the device remains greater than one, the electron flow will continue to build up. As the discharge approaches the saturation level, the loop gain G will drop back to or drop below one. Saturation in this particular embodiment is controlled by space charge limitation. Space charge limitation can be considered to be that level of saturation of electron passage wherein no additional electrons can fit through the opening of the electron optic lens formed by the opposed drift region electrodes 118. Therefore, the build-up of the electron sheet beam can be limited to a value which is controlled by applying a potential across the opposed drift region electrodes 118.

The electron sheet beam emerging from the electrodes 138 is modulated and accelerated toward the faceplate 92 by pairs of conductive strips 140, 142, 144, 146 and 148 on adjacent vertical vanes 98 in opposed parallel spaced relation. In the embodiment shown in FIG. 7, electron beam modulation is performed by a pair of opposed modulation electrodes 140 located adjacent the cathode section 100. Modulation in this depicted embodiment depends upon space charge saturation which is caused by the application of a video signal between the modulation electrodes 140. In this manner, the video signal controls the number of electrons in the electron sheet beam which are permitted to enter an accelerating and focusing section which is formed by opposed pairs of accelerating and focusing electrodes 142, 144, 146 and 148.

The faceplate 92 has a plurality of colored phosphor stripes 150 disposed thereon. For conventional color display applications, the phosphor stripes 150 include alternating groups of red, green and blue phosphors. The phosphor stripes 150 have a layer 152 of an electrically conductive material, such as aluminum, thereon which is maintained at a relatively high voltage (for example 5–25 kilovolts) over the voltage of the dynode electrode 132. This relatively large potential difference is uniformly distributed over a number of accelerating and focusing conductive strips 142, 144, 146 and 148 in order to prevent electrical breakdown along the support between the cathode section 100 and the faceplate 92. The number of voltage distributing strips is not critical, although there should be a sufficient number not to expose too much of the insulating support vanes thus possibly causing undesirable charging effect, and yet there should not be so many as to unduly complicate device construction. The modulated electron beam strikes the phosphor stripes 150 under the influence of the voltage applied to the conductive layer 152, causing the phosphors to emit light of their characteristic colors.

A major advantage of the cold cathode device of the present invention lies in the ability of the device to generate a large quantity of electrons over a large area. Another advantage lies in the finite upper energy limit for photoexcited electrons. An electron emitted from the multiplier cathode has a hard energy limit which is set by the radiation feedback energy. At UV radiation feedback energies, this absolute upper energy limit is well under 5 volts and the emission from a multiplier cathode can be shut totally off with less than a 5 volt signal on the switching electrode. In addition, the device of the present invention incorporating electron multiplication means permits the use of stable materials and reasonable voltage levels in a high vacuum device.

I claim:

1. An image display device comprising an evacuated envelope within which is disposed a plurality of cathodoluminescent cells in a matrix array, each cell including:

a. a source of electrons comprising:
   1. an anode electrode having means for producing electromagnetic radiation in response to bombardment by electrons;
   2. a cathode electrode having means for emitting electrons in response to impinging electromagnetic radiation;
   3. an open channel between said anode electrode and said cathode electrode whereby a fraction $F_c$ of the electromagnetic radiation produced by said anode electrode is clear to feed back to and impinge upon said cathode electrode; and
   4. means for sustaining a flow of electrons from said cathode electrode to said anode electrode;

b. electron beam formation means;

c. means for modulating a flow of electrons from said electron beam formation means;

d. means for accelerating the modulated flow of electrons; and e. a cathodoluminescent screen excitable by the accelerated and modulated flow of electrons, said screen being separate from said anode electrode.

2. An image display device in accordance with claim 1 in which said anode electrode comprises a layer of an electrically conductive material having a phosphor deposit with a fluorescence efficiency $E_p$ thereon.

3. An image display device in accordance with claim 2 in which said cathode electrode comprises a photocathode having an electron emissive surface portion with a photoemissive efficiency $E_c$ facing said anode electrode.

4. An image display device in accordance with claim 3 wherein said source of electrons has a loop gain equal to $F_c \times E_c \times E_p \times G_m \times V_a$, in which said electron flow sustaining means comprises an electron multiplier including at least one dynode for multiplying the number of electrons from said photocathode to said anode electrode at a potential $V_a$, said electron multiplier having a gain $G_m$ of a magnitude such that the loop gain G is greater than unity.

5. An image display device in accordance with claim 4 in which said cathodoluminescent screen comprises a plurality of phosphor deposits, each phosphor deposit being associated with a cell of said matrix and wherein said phosphor deposits include at least two different color emitting phosphors.

6. An image display device in accordance with claim 5 in which said electron multiplier includes space charge saturation means between said anode electrode and said photocathode for limiting current produced by said source of electrons.

7. An image display device in accordance with claim 6 in which said anode electrode is disposed on at least one surface of said electron multiplier between said photocathode and an output of said electron multiplier.

8. An image display device in accordance with claim 1 in which said matrix of cathodoluminescent cells is defined by the orthogonal intersections of two sets of parallel insulating vanes.

9. A structure for an image display device, comprising:

an evacuated envelope including a transparent front panel and a back panel spaced from said front panel, said front panel having a cathodoluminescent screen thereon, said back panel including a cathode electrode having means for emitting electrons in response to impinging electromagnetic radiation;

a plurality of first vanes substantially perpendicular to and contacting said back panel, said first vanes being spaced from and parallel to each other, at least some of said first vanes including an anode electrode having means for producing electromagnetic radiation in response to bombardment by electrons, a fraction of the electromagnetic radiation produced by said anode electrode being free to feed back to and impinge upon said cathode electrode, at least some of said first vanes including dynodes for multiplying electrons;

a plurality of second vanes, substantially perpendicular to and contacting said front panel, said second vanes being spaced from and parallel to each other and transverse to said first vanes, said first and second vanes being mutually supporting; and said first and second vanes having electroding thereon for controlling operation of said device.

10. An image display device structure in accordance with claim 9 in which said first and second vanes are substantially mutually perpendicular.

* * * * *